US010155237B2

(12) United States Patent
Huang

(10) Patent No.: US 10,155,237 B2
(45) Date of Patent: Dec. 18, 2018

(54) PERFUME BUMP WITH EXTERNAL SPRING

(71) Applicant: Z&Z DEVELOPMENT CO., LTD., Yuyao, Zhejiang (CN)

(72) Inventor: Jianyi Huang, Yuyao (CN)

(73) Assignee: Z&Z DEVELOPMENT CO., LTD., Yuyao (CN)

( * ) Notice: Subject to any disclaimer, the term of this patent is extended or adjusted under 35 U.S.C. 154(b) by 0 days.

(21) Appl. No.: 15/227,681

(22) Filed: Aug. 3, 2016

(65) Prior Publication Data

US 2017/0036224 A1 Feb. 9, 2017

(30) Foreign Application Priority Data

Aug. 6, 2015 (CN) ..... 2015 1 0477489

(51) Int. Cl.
*A45D 34/02* (2006.01)
*B05B 11/00* (2006.01)

(52) U.S. Cl.
CPC ..... *B05B 11/0044* (2018.08); *A45D 34/02* (2013.01); *B05B 11/3025* (2013.01); *B05B 11/3047* (2013.01); *A45D 2200/056* (2013.01); *A45D 2200/057* (2013.01); *B05B 11/3074* (2013.01)

(58) Field of Classification Search
CPC .... B05B 1/3001; B05B 11/3025; A45D 34/02
USPC ..... 222/340
See application file for complete search history.

(56) References Cited

U.S. PATENT DOCUMENTS 3,865,313 A * 2/1975 Kondo ..... B05B 11/3039 222/321.2
2011/0303702 A1* 12/2011 Wang ..... B05B 11/3023 222/336
2013/0126639 A1* 5/2013 Tu ..... B05B 11/0056 239/302
2014/0138409 A1* 5/2014 Beranger ..... B05B 11/3025 222/321.2
2015/0060493 A1* 3/2015 Duquet ..... A61L 2/088 222/148
2015/0083757 A1* 3/2015 Muller ..... B05B 11/0037 222/321.7

FOREIGN PATENT DOCUMENTS

CN 104058163 A 9/2014

* cited by examiner

*Primary Examiner* — Jeremy Carroll
(74) *Attorney, Agent, or Firm* — Oliff PLC

(57) ABSTRACT

A perfume bump valve needle unit has a valve needle, piston, spring and valve rod. A bump body unit has a valve needle unit, bump body, glass bulb and inner stopper. A bump head unit has an alumina press cap, spay chip and head cap. A valve rod external diameter between the inner piston and stopper has a Y-shaped spring with an end fixed to a recess and hold. A piston limit is at the valve needle head; an opposing needle bar sets into the rod center hole. A ring recess at the valve needle bar end snap-fits with a rod inner diameter ring buckle. The valve needle external diameter has an effluent trough from the ring recess to the head. A piston internal ring and rod external diameter fit and seal. A channel between trough and piston open when the rod, piston and valve needle move to the bulb.

8 Claims, 5 Drawing Sheets

PERFUME BUMP WITH EXTERNAL SPRING

TECHNICAL FIELD

The present invention related to a micro sprayer, which is a perfume bump with external spring.

BACKGROUND TECHNOLOGY

At present, there are many types of micro sprayers in the market. These micro sprayers atomize and spray the liquid in the container by pressing the lever or head cap. The working principle is: piston moves in bump body, which make air flow and lower the pressure inside the bump body, while pressure outside bump body is unchanged. It produces pressure difference inside and outside the bump body. Take advantage of pressure difference, to lead liquid out from bump body, and the liquid will be instantaneously atomized when encountering high speed flow. It is an application of Bernoulli's principle: for a same liquid, high flow corresponds to low pressure; low flow corresponds to high pressure. These sprayers have been widely used in flower planting, hair salon and cosmetology, etc. wherein, some micro sprayers with press head cap are mainly used to cosmetology industry as perfume sprayer, which is also called perfume bump. To prevent perfume and spring from being affected due to chemical reaction between metal spring of bump body and liquid perfume, some perfume bumps adopt external spring. E.g. "press perfume sprayer with external spring and its dual pressing method" with application number of 201410193366.5 and application announcement date of 2015 May 7 disclosed by Chinese patent literature. Piston, valve needle, inner stopper, long spring, short spring and valve rod form the valve needle unit of the sprayer. The said valve needle unit, bump body and glass bulb form bump body unit. Alumina press cap, spray chip and head cup form bump head unit. The key point is that the said valve needle of valve needle unit sets into piston with interference, and piston sets into inner stopper with interference; the inner stopper snap-fit with bump body, and the valve needle snap-fit with valve rod. Long spring is located between inner stopper and valve rod, and short spring is located between valve rod and valve needle. The long spring is equipped in external diameter of short spring. In the same time, valve needle unit realizes dual pressing through long spring and short spring, and limits the piston by stepped terminal angle of inner diameter of bump body. Although the spring of the said structure has realized external spring, and prevent the perfume from being effected by spring, some deficiencies are existed: weak stability of structure of the external spring, inconvenient assembly and production, and complicated process.

Invention Content

To overcome the said deficiencies, the invention is aimed to provide a perfume bump with external spring in the field, to solve technical matters of existing similar lotion bump, e.g. nozzle is hard to be fixed or used, and poor stability of outflow effect of nozzle. The aim is realized by following technical solutions.

A perfume bump with external spring, its bump body unit is fixed at alumina bayonet; ring recess at one end of the alumina bayonet is equipped with washer. Glass bulb is equipped at the liquid inlet end inside the bump body, the other end of bump body is snap-fit with inner stopper, and sealed in boss at the end of alumina bayonet; valve rod of bump body unit extends out from inner stopper and alumina bayonet, and connected with head cap inside the alumina press cap. The head cap nozzle of alumina press cap is equipped with spry chip; the external diameter of valve needle inside the bump body is equipped with piston, and air vent is equipped at the piston of bump body. The key point is that the external diameter of valve rod between inner piston and inner stopper is equipped with special-shape spring, and the two ends of special-shape spring is fixed and connected with piston ring recess and bump hole of bump body. Piston limit is located at the needle head of valve needle, the needle bar at the other end of valve needle sets into the centre hole of valve rod. Ring recess at the needle bar end of valve needle snap-fit with ring buckle at inside diameter of valve rod. The external diameter of valve needle is equipped with effluent trough, which goes through from ring recess to needle head of valve needle. Internal ring of piston and external diameter of valve rod is sliding fit and sealed. The channel between effluent trough of valve needle and piston will open when valve rod, piston and valve needle moved to the glass bulb. The special-shape spring of the said structure is located in upper cavity of bump body outside the sealed cavity of lower cavity of bump body, and is separated by piston, i.e. set external spring structure inside the bump body of the perfume bump, to avoid direct contact between liquid and special spring during the normal use, and to avoid chemical reaction between liquid and special-shape spring, and to avoid affect on appearance and function of spring caused by rusting or pollution on liquid. In the same time, the perfume bump not only abandoned dual-spring structure of existing sprayer, lower production cost, but also improved the force of product during test.

The effluent trough of the said valve needle is channel of flat key section. The principle of the said structure is similar to the effluent trough of external diameter of valve needle. If fluid can flow into the effluent trough through the gap between valve head of valve needle and piston when the gap is open, and flow into the head cap through centre hole of valve rod, the effluent trough may also be the bar.

The said valve needle is T-head bolt, the needle head at the piston side of valve needle is equipped with valve needle ring bar, and the piston side of valve needle ring is equipped with valve needle ring recess. Valve needle ring recess and inner ring of piston is interference fit and combined; the needle head of valve needle is smaller than liquid inlet at the side of glass bulb inside bump body. Liquid inlet above glass bulb is reserved cavity for valve needle to move downward. Plane angle at liquid hole inside bump body is equipped with piston limit bar. It is means that when the special-shape spring is at initial state, the gap between valve needle and piston inner ring is sealed; when valve needle is located at the end of glass bulb, the special-shape spring will deform, and space between valve needle and piston inner ring remain sealed, and the piston limit is located at the piston limit bar inside the bump body. Keep pressing alumina press cap, the valve needle separates with piston, and the gap between valve needle and piston inner ring opens, and the liquid flows into the effluent trough at external diameter of valve needle through the gap. Therefore, the valve needle ring recess and inner ring of valve are movable sealed and fit, while inner ring of piston and outer diameter of valve rod are sliding fit and sealed. It may prevent liquid from flowing into spring cavity of upper cavity of bump body through space between valve rod and piston during use, which leads to a more reliable seal fit.

The valve needle ring bar at piston side of the said valve needle is equipped with water chute, and the water chute is connected with effluent trough of valve needle through valve needle ring recess. The said structure is convenient for liquid flows into effluent trough of valve needle through water chute when inner ring of piston separates with ring recess of valve needle, or the seal gap between valve needle and inner ring of piston deforms.

The inner diameter of ring hole at piston side of the said valve rod is equipped with piston ring recess. The external diameter of inner ring of piston and piston ring recess of valve rod is interference fit and combined. Piston is integrated with valve rod. It is convenient for valve rod brings piston move up and down when it brings valve needle move up and down, so as to ensure the sealing between piston and valve rod.

The external diameter at inner stop side of the said valve rod is equipped with valve rod ring bar, and valve rod ring recess is equipped at the piston side of valve rod ring bar. Valve road ring recess is engaged and sealed with inner stopper ring recess. The said structure has further ensured the sealing between valve rod and inner stopper when the valve rod is at its initial state.

The valve rod ring bar of the said valve rod is located in tower section of special-shape spring that is Y-shaped. One end of special-shape spring is tower spring section, and the other end is column spring section. The column section of special-shape spring is located in external diameter at piston end of valve rod. Therefore, when press alumina press cap, the special-shape spring will not affect valve rod ring bar to move up or down.

The end limit of tower section of the said special-shape spring is fixed at the stepped groove between pump hole and inner stopper of bump body. The stepped groove of bump body is located at the expansion area of bump hole on inner wall of bump body. The end limit of column section of special-shape spring is located at the stepped-raised limit ring bar at external diameter of valve rod, so as to make the upper end of special-shape ring hang on stepped groove of bump body and the limit ring bar of valve rod is able to prevent special-shape ring from separating with valve rod under force. During the use of the perfume bump, the tower section of special-shape spring is stretched and compressed, and plays the role of tensioning action of tension spring. In the same time, it may make valve rod press against and sealed with inner stopper; while the column section of special-shape spring is compressed and bounce off, and plays the role of bouncing off of spring.

The top at the centre hole of head cap is equipped with top slot, and the edge of head cap at the top slot side is equipped with arc groove. The said head cap structure mainly plays the role of elastic deformation, to ensure control of interference size between alumina press cap and head cap, so as to avoid affect on product appearance due to cracking and deformation of alumina press cap and head cap caused by excessive tighten after assembling. However, excessive loose fit may make alumina press cap and head cap falling out when pulling head cap. The said structure may make alumina press cap and head cap have more tight fit under the effect of arc Groove after assembling.

With advantages as reasonable design, good seal, convenient assembly, production and use, and good spry effect, the product is suitable for perfume and similar products, as well as for structure improvement of similar products.

Number and Name: 1. Straw; 2. Bump body; 3. Glass bulb; 4. Valve needle; 401. Effluent trough; 5. Piston; 6. Alumina bayonet; 7. Special-shape spring; 8. Washer; 9. Inner stopper; 10. Valve rod; 11. Head cap; 1101. Arc groove; 1102. Top slot; 12. Spray chip; 13. Alumina press cap

DESCRIPTION OF THE PREFERRED EMBODIMENT

Figure 1:
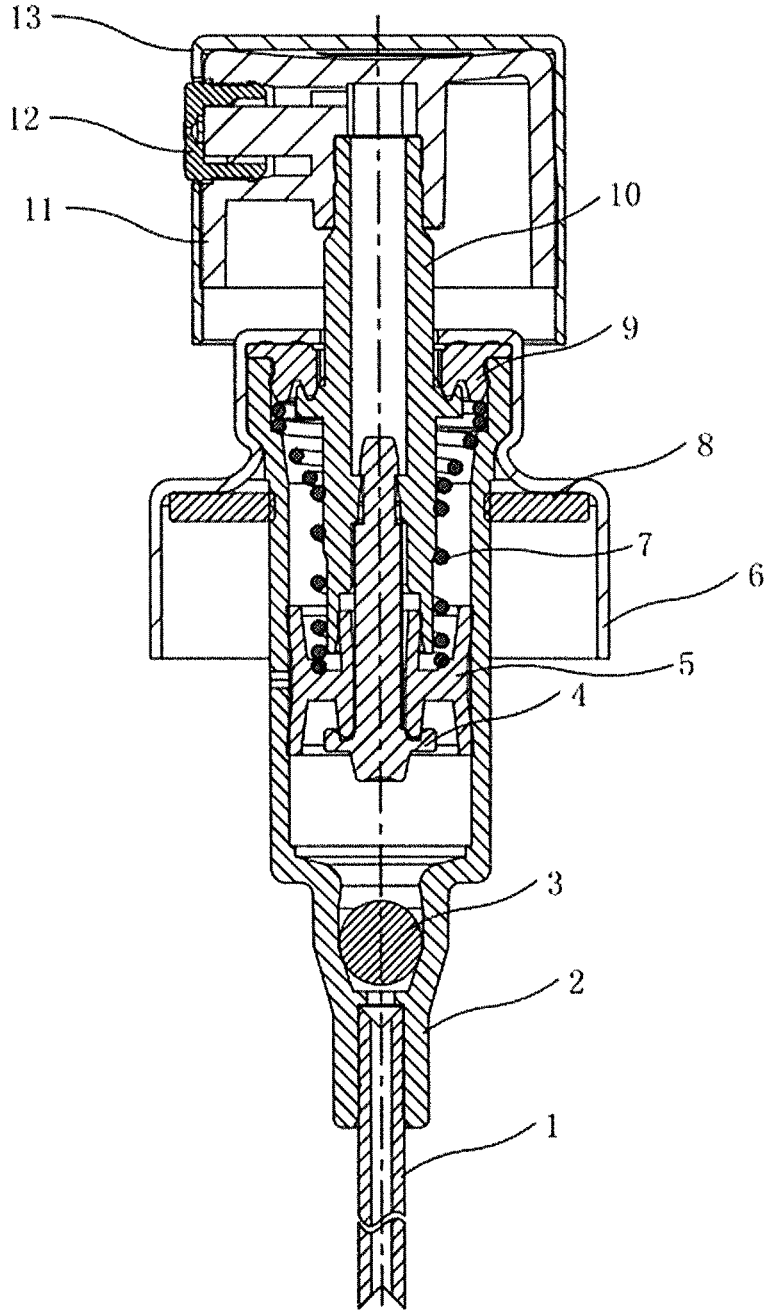
FIG. 1 is cross-sectional view of the invention at initial state.
Figure 2:
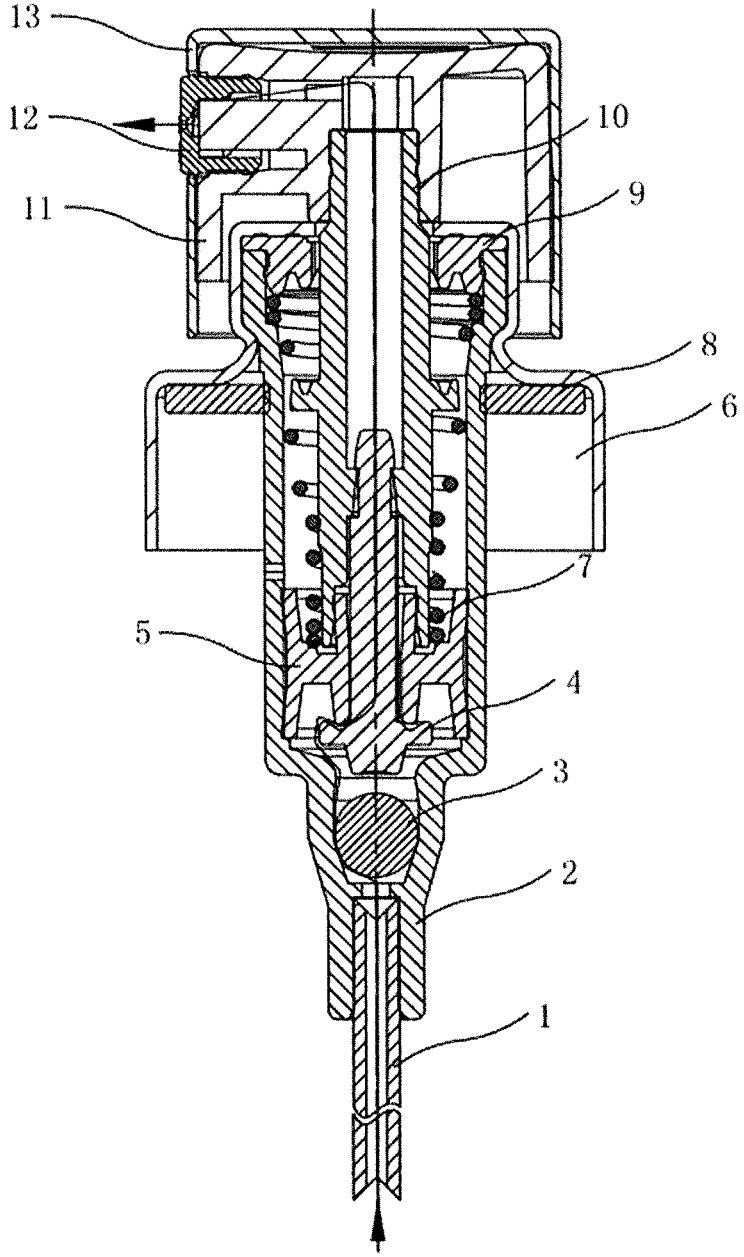
FIG. 2 is cross-sectional view of the invention of FIG. 1 at press state; arrows indicate the direction of fluid.
Figure 3:
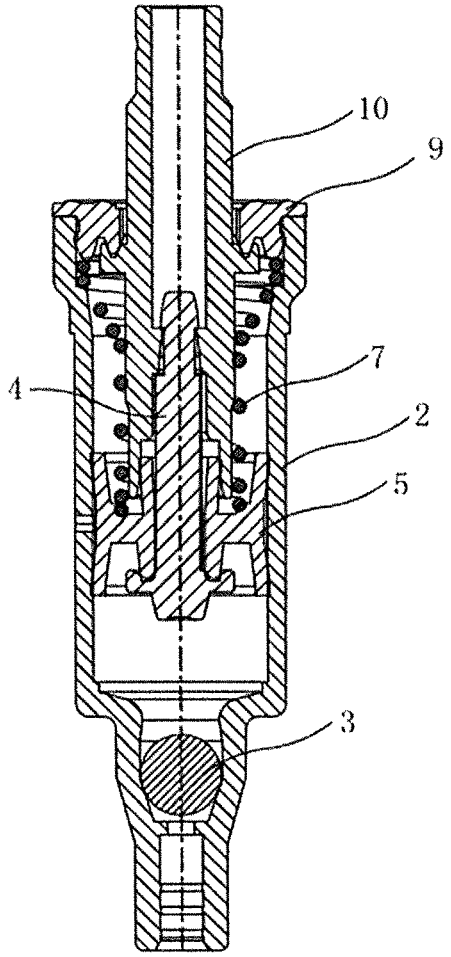
FIG. 3 is the cross-sectional view of bump body of the invention.
Figure 4:
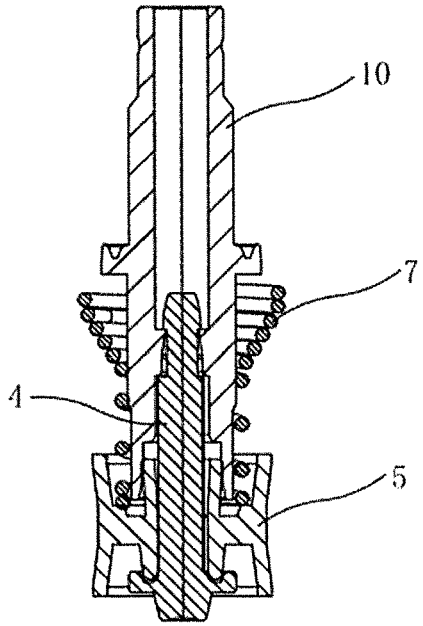
FIG. 4 is the cross-sectional view of part of FIG. 3.
Figure 5:
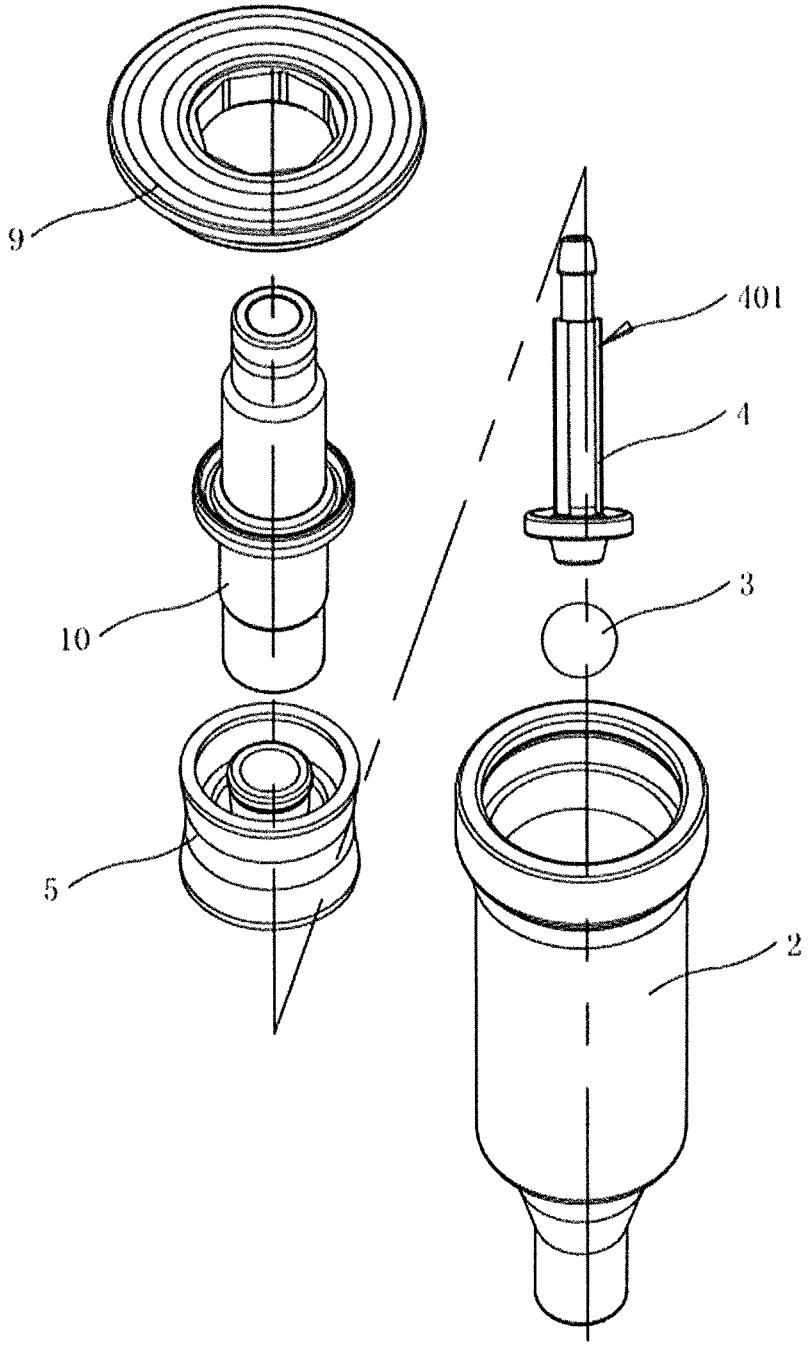
FIG. 5 is the view of explosion structure of bump body unit of the invention; the special-shape spring is omitted in the figure.
Figure 6:
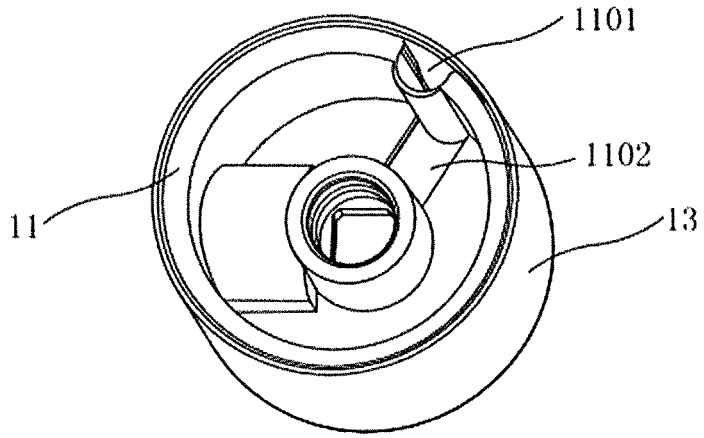
FIG. 6 is the view of internal structure of alumina cap.
Figure 7:
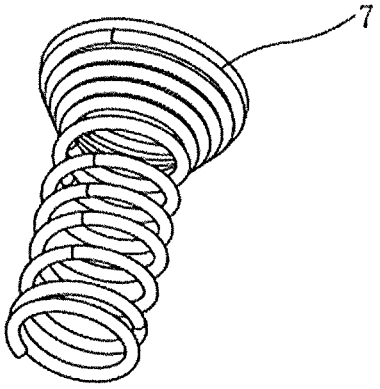
FIG. 7 is the structural view of special-shape spring of the invention.

Turning to the drawings, and further description of structure and usage of the invention is provided. As shown in FIG. 1-7, the perfume bump is integrated by straw 1, bump body 2, glass bulb 3, valve needle 4, piston 5, Alumina bayonet 6, special-shape spring 7, washer 8, inner stopper 9, valve rod 10, head cap 11, spray chip 12, and alumina press cap 13. The valve needle unit is composed by valve needle, piston, special-shape spring and valve rod, while bump body unit is composed by valve needle unit, bump body, glass bulb and inner stopper. Bump head unit is composed by press cap, spay chip and head cap. The glass bulb is located at the end of liquid inlet inside the bump body, and is movable fit and sealed with slope at the liquid inlet of bump body, and fixed by buckle and controls the movement stroke of glass bulb. Special-shape spring is located in external diameter of valve rod between inner diameter of bump body and valve rod, two ends of special spring fixed of stepped groove of upper pump inlet of bump body and stepped raised limit ring bar of external diameter of piston section of valve rod respectively. The external diameter of valve needle is equipped with effluent trough 401; the needle head end of valve needle is equipped with valve needle ring bar, whose piston side is equipped with valve needle ring recess. The valve needle ring recess is press against with glass bulb end of inner ring of piston. The valve needle ring recess and inner ring of piston are movable fit and sealed; the ring recess at needle bar of valve needle is snap-with ring buckle at inner diameter of valve rod. They are buckled tightly, to avoid separation of valve needle and valve bar under the action of special-shape spring. The inner ring of piston and outer diameter of valve rod are glidingly connected and sealed. It may prevent liquid from flowing into spring cavity of upper cavity of bump body through space between valve rod and piston when the seal between valve needle and piston are open. The external ring of piston and cavity surface of inner wall of bump body is sliding fit and sealed. The bump body is separated by piston into upper cavity and lower cavity. The upper cavity is spring cavity, and the lower cavity is seal cavity, i.e. piston, valve needle, bump body and glass bulb form seal cavity, while piston, inner stopper, valve rod and bump body form spring cavity. The special-shape spring is located in spring cavity.

The specific structure: ring recess at one end of alumina bayonet 6 is equipped with washer 8. Glass bulb 3 is equipped at the end of liquid inlet inside the bump body 2, the other end of bump body is snap-fit with inner stopper 9, and sealed in boss at the end of alumina bayonet; valve rod 10 of bump body unit extends out from inner stopper and alumina bayonet, and connected with head cap 11 inside the alumina press cap 13. The top at the centre hole inside of head cap is equipped with top slot 1102, and the edge of head cap at the top slot side is equipped with arc groove 1101. The centre hole of valve rod is connected with head cap hole, and the head cap nozzle of alumina press cap is equipped with spry chip 12. The external diameter of valve needle 4 inside the bump body is equipped with piston 5. The external diameter at inner stop side of the said valve rod is equipped with valve rod ring bar, and valve rod ring recess is equipped at the piston side of valve rod ring bar. The valve road ring recess is engaged and sealed with inner stopper 9 ring recess. The external diameter of valve rod between inner piston and inner stopper is equipped with special-shape spring 7. The special-shape spring that is Y-shaped. One end of special-shape spring is tower spring section, and the other end is column spring section. The valve rod ring bar of the said valve rod is located in tower section of special-shape spring. The column section of special-shape spring is located in external diameter at piston end of valve rod. Piston limit is located at the needle head of valve needle, the needle bar at the other end of valve needle sets into the centre hole of valve rod. Ring recess at the needle bar end of valve needle snap-fit with ring buckle of inside diameter of valve rod. The effluent trough 401 of valve needle goes through from ring recess to needle head of valve needle. The valve needle is T-head bolt. The needle head of valve needle is smaller than liquid hole at the side of glass bulb inside bump body. Liquid inlet above glass bulb is reserved cavity for valve needle to move downward. Plane angle at liquid hole inside bump body is equipped with piston limit bar.

In the same time, the stepped groove of bump body is located at the expansion area of bump hole on inner wall of bump body. The piston side of valve needle ring is equipped with valve needle ring recess. Valve needle ring recess and inner ring of piston is interference sealed and combined; piston is integrated with valve rod. The air vent is equipped at the piston of bump body, i.e. the air vent is equipped between seal plastics at two ends of external ring of piston. The external diameter of rod mouth of valve rod and head cap is buckled through concave-convex bar, to avoid loosening due to temperature and aging. The chip is located inside the spray chip hole of alumina press cap, and limited the movement scope of alumina press cap, to prevent head cap and alumina press cap from being loosening or falling out due to expansion-shrinkage caused by temperature or time factors after assembly, as well as to prevent alumina press cap from falling out by pulling head cap.

During use of the perfume bump, press head cap, the tower section of special-shape spring will be stretched and deformed, to make head cap drive valve rod, piston and valve needle move downward. At the moment, the pressure inside the seal cavity is greater than external pressure, and pressure difference has been formed. When piston presses against the step at glass bulb inside the bump body, keep pressing head cap, and the column section of special-shape spring will tighten, and make movable seal between inner ring of piston and ring recess of valve needle open. The pressure will enter the spray chip of bump head unit through effluent trough of valve needle, and be atomized and sprayed out. Loosen head cap, the inner ring of piston and ring recess of valve needle will be sealed under the action of back stretch due to compressed column section of special-shape spring, and force each component reset under tensioning action of tower section of special-shape spring. At the moment, the inner pressure of seal cavity will reduce, and the movable seal slope between glass bulb and fluid inlet of bump body will open automatically. The fluid will flow into seal cavity through straw under pressure. Repeat the action and the fluid will be sprayed out.

The invention claimed is:

1. A perfume bump with external spring comprising:

a bump body that is fixed with a bayonet, and a first end of the bayonet includes a washer;

a glass bulb that is disposed at a first end of the bump body such that the glass bulb is inside the bump body, the first end of the bump body being a liquid inlet end;

a stopper that is disposed at a second end of the bump body, the second end of the bump body being snap-fit with the stopper, and the stopper being sealed within an end of the bayonet;

a valve rod that extends within the bump body such that the valve rod is radially inward of the stopper and of the bayonet;

a press cap that is connected to the valve rod and that includes a spray chip;

a spring that is connected to the valve rod;

a valve needle that is disposed radially inward of the spring; and a piston that slidably divides the bump body into an upper cavity and a lower cavity, and is disposed at least partly radially outward of the valve needle, the upper cavity being located toward the stopper, the lower cavity being located toward the glass bulb, wherein:

the spring, the valve needle, and the piston are all disposed within the bump body, the spring is fixedly connected to the piston, the spring is the only spring in the perfume bump and is provided inside the upper cavity, the lower cavity is configured to contain perfume and is sealed from the upper cavity to prevent direct contact between the spring and the perfume, the valve needle is disposed within a center hole of the valve rod, a ring is disposed at a first end of the valve needle, an external surface of the valve needle includes a trough, which is in sliding engagement with the ring to provide a moveable seal, the spring extends from the stopper to the piston, and movement of the press cap downwards, towards the glass bulb, causes the piston to apply a downward force on the glass bulb and causes the moveable seal to open so that liquid is sprayed from the perfume bump.

2. The perfume bump according to claim 1, wherein the trough is a channel with a flat section.

3. The perfume bump according to claim 1, wherein the valve needle is a T-head bolt, and a cavity above the glass bulb is reserved for the valve needle to move downward.

4. The perfume bump according to claim 1, wherein the valve rod includes a recess such that a portion of the piston is disposed in the recess.

5. The perfume bump according to claim 1, wherein the valve rod forms an interference fit with the stopper.

6. The perfume bump according to claim 1, wherein the spring is attached to the stopper and to the piston.

7. The perfume bump according to claim 1, wherein the press cap includes a top slot with an arc groove.

8. The perfume bump according to claim 1, wherein the spring has a Y-shape with a tower section toward the stopper and a column section toward the piston.

* * * * *